US011786765B2

(12) United States Patent
Hayran

(10) Patent No.: US 11,786,765 B2
(45) Date of Patent: Oct. 17, 2023

(54) COOLING ELEMENT FOR USE IN A COOLING DEVICE OF A CLOSED-CIRCUIT RESPIRATOR

(71) Applicant: Dräger Safety AG & Co. KGaA, Lübeck (DE)

(72) Inventor: Ugur Hayran, Lübeck (DE)

(73) Assignee: Dräger Safety AG & Co. KGaA, Lübeck (DE)

( * ) Notice: Subject to any disclaimer, the term of this patent is extended or adjusted under 35 U.S.C. 154(b) by 581 days.

(21) Appl. No.: 17/076,241

(22) Filed: Oct. 21, 2020

(65) Prior Publication Data

US 2021/0121718 A1 Apr. 29, 2021

(30) Foreign Application Priority Data

Oct. 24, 2019 (DE) ..... 10 2019 007 408.4

(51) Int. Cl.
*A62B 9/00* (2006.01)

(52) U.S. Cl.
CPC ..... *A62B 9/003* (2013.01)

(58) Field of Classification Search
CPC .. A62B 9/00; A62B 9/003; A62B 7/00; A62B 7/10; A62B 18/00; A62B 18/08; B63C 11/24; B63C 11/22; B63C 11/18; B63C 11/02; B63C 11/00; A61M 16/00; A61M 16/0003; A61M 16/10; A61M 16/1075; A61M 16/0891; A61M 2205/36; A61M 2205/3606; A61M 2205/362; A61M 2205/3646; A61M 2205/127; A61M 2205/3368; A61M 2205/366; A61F 2007/0054; A61F 2007/0056; A61F 2007/0057; F28D 2020/0008; F28D 1/0233; F24F 5/0021; F25D 2303/082; F25D 2303/0822
See application file for complete search history.

(56) References Cited

U.S. PATENT DOCUMENTS 5,269,293 A * 12/1993 Loser ..... F25B 17/08 128/204.15
9,950,198 B2 * 4/2018 Johnson ..... F25B 49/00
2011/0247618 A1 10/2011 Koch
(Continued)

FOREIGN PATENT DOCUMENTS

FR 2490800 A1 3/1982
JP 2014052146 A 3/2014
WO 2012073024 A2 6/2012

*Primary Examiner* — Colin W Stuart
(74) *Attorney, Agent, or Firm* — McGlew and Tuttle, P.C.

(57) ABSTRACT

A cooling element (100) for use within a cooling device (600) of a closed-circuit respirator (690), includes a plate shaped cooling element housings (110, 120), each with a respective liquid-tight closure (112, 122) filled or to be filled with a coolant (211). The cooling element housings (110, 120) each have a plate outer wall (114, 124) and a plate inner wall (116, 126) arched in the direction of the plate outer wall, which form, together with additional side walls (115, 125), cooling element volumes (118, 128) for the coolant. The plate shape cooling housings can be fastened or are fastened to each other such that the one plate inner wall and another plate inner wall are located opposite each other and are arched away from one another.

20 Claims, 4 Drawing Sheets

(56) References Cited

U.S. PATENT DOCUMENTS

| | | | | |
|---|---|---|---|---|
| 2014/0261411 | A1* | 9/2014 | Berney-Smith ... | A61M 16/0891<br>128/202.22 |
| 2016/0213879 | A1* | 7/2016 | Parthasarathy ..... | A61M 16/208 |
| 2017/0143933 | A1* | 5/2017 | Pasadilla ..... | B01D 53/265 |

* cited by examiner

COOLING ELEMENT FOR USE IN A COOLING DEVICE OF A CLOSED-CIRCUIT RESPIRATOR

CROSS REFERENCE TO RELATED APPLICATIONS

This application claims the benefit of priority under 35 U.S.C. § 119 of German Application 10 2019 007 408.4, filed Oct. 24, 2019, the entire contents of which are incorporated herein by reference.

TECHNICAL FIELD

The present invention pertains to a cooling element for use within a cooling device of a closed-circuit respirator. The present invention pertains, furthermore, to a cooling device for a closed-circuit respirator and to a closed-circuit respirator.

TECHNICAL BACKGROUND

The use of a cooling device in a closed-circuit respirator for cooling a breathing gas stream is known and necessary. Thus, a lime, which is typically used as an absorbent for gas treatment, and which treats the breathing gas by removing $CO_2$, produces heat continuously. In the closed breathing gas circuit, this leads over the duration of the use of the closed-circuit respirator to a rise in the temperature of the gas to be inhaled by the user of the closed-circuit respirator into a temperature range that is at least extremely uncomfortable for the user during the inhalation. Provisions are therefore made for a continuous cooling of the breathing gas circuit by a cooling device. The cooling device has a coolant, which is typically cooled to below its melting point prior to the use of the closed-circuit respirator.

The coolant is preferably ice or a coolant, which is configured as a phase-change material (PCM) and which is used within a cooling element, e.g., within a liquid battery, in the closed-circuit respirator.

SUMMARY

An object of the present invention is to make possible an especially simple handling of a cooling element, especially an especially robust use of a cooling element.

To accomplish this object, a cooling element for use within a cooling device of a closed-circuit respirator with a first plate-like (plate shape) cooling element housing and with a second plate shape cooling element housing is proposed according to the present invention.

The two cooling element housings each have in this case a liquid-tight closure and are filled or can be filled with a coolant. The first cooling element housing has a first plate outer wall and essentially parallel thereto a first plate inner wall, which is arched in the direction of the first plate outer wall, which form a first cooling element volume for the coolant together with additional first side walls. The second cooling element housing has a second plate outer wall and essentially parallel thereto a second plate inner wall, which is arched in the direction of the second plate outer wall, which form a second cooling element volume together with additional second side walls.

The first plate shape cooling element housing can be fastened or is fastened, especially permanently fastened according to the present invention to the second plate shape cooling element housing via a fastening device such that the first plate inner wall and the second plate inner wall are located opposite each other, they are especially located directly opposite each other, and are arched away from one another.

It was found within the framework of the present invention that many coolants, which are typically used in case of the use of a closed-circuit respirator, such as water, change their volume in the range of their melting point and above that range, as a result of which problems may arise during the removal of a cooling element from the cooling device or from a freezing device. Furthermore, it was found that such problems caused by a deformation of the cooling element can be circumvented by this deformation taking place in a controlled manner, especially in a controlled manner without a change in the outer structure of the cooling element.

Such a controlled deformation is advantageously possible by means of the cooling element according to the present invention. Thus, even though a change in the volume of the coolant ensures a deformation of the corresponding plate shape cooling element housing, this deformation affects essentially an area within the cooling element due to the arching of the two plate inner walls. Due to the fact that the first and second plate inner walls are arched away from one another, this area is formed within the cooling element. A deformation of a cooling element housing at one of these plate inner walls does not lead to a deformation of a plate outer wall. As a result, an essentially constant structure of the outer surfaces of the cooling element can be made possible despite a deformation based on an increase in the volume of the coolant.

It is ensured by the position according to the present invention of the two arched plate inner walls that the cooling element has an unchanged outer surface even after a temperature-related change in the volume of the coolant within one of the two coolant housings and it can as a result be removed from the cooling device or inserted into this in a simple manner. Furthermore, the removal from a freezing device can likewise be especially simple due to the cooling element according to the present invention. For example, water as a coolant thus expands when it reaches a temperature below the melting point, so that the cooling element according to the present invention makes such an expansion possible especially advantageously at the melting point without a displacement of the plate outer surfaces being necessary for this.

Furthermore, the cooling element according to the present invention has an advantageous configuration due to its plate shape. Such plate shape cooling element housings can be stored and transported in an especially simple manner. Furthermore, the plate shape allows, in relation to the available cooling element volume, an especially large surface and hence an especially large area, at which a heat exchange with a gas to be cooled, which flows through the cooling device, can take place.

The cooling element according to the present invention makes it especially advantageously possible to rapidly replace and/or rapidly remove the cooling element from the cooling device, because deformations of the cooling element are avoided. This is especially advantageous when the correspondingly configured closed-circuit respirator is used within the framework of time-critical applications, for example, firefighting or in mining.

The provision of an arch according to the present invention of the respective plate inner wall makes it also possible, in addition to the advantages described in the presence of an overpressure within the cooling element volume, advantageously to change the structure of the cooling element housing in the area of the plate inner wall in a controlled manner even in the presence of a vacuum, without the outer surfaces in the area of the plate outer walls undergoing a change. As a result, the change in the position of the cooling element within the cooling device is avoided even in case of a vacuum, as a result of which a rapid and simple removal or replacement of the cooling element is possible during a use.

The provision of the cooling element housing according to the present invention advantageously makes possible a lasting use of the same coolant for several uses. Replacement of the cooling can thus advantageously be avoided.

The fastening device is preferably a mechanical fastening device. Especially preferred is a positive-locking and/or non-positive fastening of the first plate shape cooling element housing to the second plate shape cooling element housing. The fastening may be, for example, a latching mechanism. In particular, the fastening device may have a fastening element at the first plate shape cooling element housing and a corresponding additional fastening element at the second plate shape cooling element housing, so that an interaction between the two fastening elements leads to a fastening of the two cooling element housings to one another. To provide an especially secure fastening, a corresponding fastening element may also be provided at a plurality of areas of the respective cooling element housing in order to fasten the two cooling element housings to one another in a plurality of areas of the respective cooling element housing. The fastening may lead according to the present invention to a detachable connection between the two plate shape cooling element housings or to a permanent, non-detachable connection between the two plate shape cooling element housings. A permanent, non-detachable connection is brought about preferably by welding or bonding. The cooling element can advantageously have an especially robust configuration due to a permanent, non-detachable connection.

The liquid-tight closure may be a detachable connection, e.g., a screw connection, or a permanent connection, especially a permanent, non-detachable closure closed during the manufacture of the cooling element, for example, by welding.

In addition to the coolant, a remaining part of the cooling element volume may be filled by a gas. The advantages described are also present, in addition to the changes in the volume of the coolant, for the changes in the volume, especially for the temperature- and/or pressure-related changes in the volume of this gas.

Preferred embodiments of the cooling element according to the present invention will be described below.

In a preferred embodiment, the two plate shape cooling element housings are manufactured from a plastic. The two cooling element housings can be manufactured in this embodiment in an especially simple and cost-effective manner. In a variant of this embodiment, the two plate shape cooling element housings are manufactured by an injection molding process or by deep drawing. In particular, the cooling element housing is manufactured especially advantageously by a twin sheet process, in which two components are deep-drawn and are then bonded or welded together. An especially small wall thickness is made possible hereby. In an alternative or additional variant of this embodiment, the two plate shape cooling element housings are manufactured each in one piece. The number of processing steps can be reduced hereby during the manufacture of the cooling element according to the present invention. In an especially preferred variant of this embodiment, the two cooling element housings are attached to one another permanently and non-detachably by means of welding. Such a welding is possible in the case of plastic parts in a simple and especially reliable manner.

In an especially preferred embodiment, the two plate outer walls have a stiffer configuration than the two plate inner walls within the respective cooling element housing. As a result, an overpressure within the respective cooling element volume causes areas of the two plate inner walls, which areas are arched away from one another, to move towards one another. It can be ensured in an especially reliable manner in this embodiment that a change in the volume of the coolant leaves the plate outer walls essentially unchanged, while the corresponding plate inner wall and/or both plate inner walls move towards one another during an expansion of the volume. A further expansion of the corresponding coolant would lead to a change in the plate outer walls only if the plate inner walls will have moved towards one another to the extent that no further movement is possible. However, closed-circuit respirators are typically used in a comparatively narrow temperature range, e.g., between 0° C. and 50° C., so that such a great change in the volume of the coolant that this would cause a change in the plate outer walls in addition to a movement of the plate inner walls cannot typically occur.

In an advantageous variant of the above embodiment, at least one plate outer wall has a greater material thickness than the corresponding plate inner wall of the corresponding cooling element housing. As a result, a cooling element in which the two plate outer walls are stiffer than the two plate inner walls can be provided in an especially simple manner. The material thickness of the plate inner wall is preferably less than 4 mm, especially less than 2 mm and especially preferably less than 1 mm in this variant.

In an advantageous additional or alternative variant of the above embodiment, the plate outer wall and the plate inner wall of at least one plate shape cooling element housing are formed from two different materials. The material of the plate outer wall has a higher modulus of elasticity than the material of the plate inner wall. The use of two different materials makes, in turn, possible an especially simple manufacture of a cooling element, in which the two plate outer walls are stiffer than the two plate inner walls. For example, the plate outer wall may be formed from a sheet metal, while the plate inner wall consists, for example, of a flexible plastic. The connection between the plate outer wall and the plate inner wall via the side walls is preferably a permanent connection, for example, a connection established by welding or bonding. The plate inner wall especially preferably has, in addition, a smaller material thickness than the corresponding plate outer wall.

In an especially preferred embodiment, the cooling element has, furthermore, at least one elastic spacer, which is arranged, especially fastened, at an arched-away area of at least one of the plate inner walls such that it exerts a spring force between the two plate inner walls located opposite each other such that it counteracts a movement of the arched-away areas of the two plate inner walls towards one another. The elastic spacer ensures in this embodiment that a displacement of the corresponding plate inner wall takes place only beginning from a certain overpressure within the corresponding cooling element housing. In particular, it is ensured by the elastic spacer that only a weak spring force must be counteracted in case of a small displacement of the corresponding plate inner wall in case of a small change in the volume of the coolant. The spring force provided by the elastic spacer is preferably nonlinear to the expansion of the spacer, so that a comparatively much higher overpressure must exist within the cooling element housing for large changes in volume and for a correspondingly great displacement of the plate inner wall than for a small displacement of the plate inner wall. In particular, a contact between the two plate inner walls is avoided and said plate inner walls are prevented from forcing a structural change of the plate outer wall in this embodiment, because this would only occur at a very high overpressure within the cooling element housing. The provision of an elastic spacer advantageously ensures that the arching of the two plate inner walls, which is originally present without overpressure, is reached again when an overpressure subsides within the respective cooling element housing.

In an advantageous variant of the above embodiment, the cooling element has a plurality of elastic spacers. Due to the plurality of elastic spacers, the spring force can act especially homogeneously over the corresponding areas of the plate inner walls. As a result, damage to a plate inner wall at a high overpressure is avoided.

In an advantageous additional or alternative variant of the above embodiment, the elastic spacer is a compression spring. The elastic spacer can be provided in this variant in an especially simple and favorable manner. Furthermore, a compression spring is an especially robust, elastic spacer. In a preferred example of this variant, the cooling element has a plurality of elastic spacers and hence a plurality of compression springs.

In another embodiment of the cooling element according to the present invention, the cooling element has, in addition to the first and second plate shape cooling element housings, at least one additional plate shape cooling element housing, wherein the at least one additional cooling element housing is arranged between the first plate shape cooling element housing and the second plate shape cooling element housing and has two additional plate inner walls arched towards one another as outer surfaces, wherein the additional plate inner walls are arranged such that the first plate inner wall and at least one of the additional plate inner walls are located opposite each other and are arched away from one another, and that the second plate inner wall and at least one of the additional plate inner walls are located opposite each other and are arched away from one another. An especially large quantity of coolant can be provided within a cooling element due to the provision of more than two cooling element housings. Furthermore, an especially large surface can be provided by a plurality of cooling element housings located at closely spaced locations next to one another in order to cool the gas stream of a gas to be cooled by a heat exchange on this surface.

In an especially preferred embodiment, a respective plate inner wall is arched completely to the corresponding plate outer wall of the corresponding cooling element housing. In an alternative or additional embodiment, a part of a respective plate inner wall is arched to the corresponding plate outer wall of the corresponding cooling element housing. In another alternative or additional embodiment, a respective plate inner wall has a plurality of areas, which have at least one arch, which is arched to the corresponding plate outer wall of the corresponding cooling element housing. The provision of a plurality of arches can keep low a change in the structure of the corresponding plate inner wall in the presence of an overpressure or vacuum, because it is unlikely that all the arches would contribute at the same time to a displacement of the plate inner wall in the direction of the respective plate inner wall located opposite it.

According to another aspect of the present invention, a cooling device for a closed-circuit respirator with at least one cooling element according to at least one of the above embodiments and with a device housing is proposed to accomplish the above-mentioned object.

The device housing has a gas inlet, which is configured to admit a gas to be cooled into the device housing. Furthermore, the device housing has a gas outlet, which is configured to let the gas admitted into the device housing through the gas inlet out of the device housing. Finally, the device housing has, furthermore, a device volume, which is enclosed by a housing wall of the device housing and which can replaceably accommodate the at least one cooling element, wherein the device housing is configured such that a gas stream of the gas to be cooled can reach the gas outlet from the gas inlet through the device volume having the at least one cooling element.

The combination of cooling element and device housing according to this additional aspect of the present invention makes it advantageously possible for the cooling device to be configured corresponding to the outer structure of the cooling element according to the present invention. As a result, the space within the cooling device is utilized especially efficiently by the number of cooling elements, so that an especially small overall size of the cooling device is possible.

In another embodiment, the gas stream of the gas to be cooled can pass through the area between the first and second plate shape cooling element housings. An especially efficient heat exchange is possible in this embodiment at the surface of the respective cooling element housing, as a result of which an especially efficient cooling is brought about by the cooling device according to the present invention.

The device volume can accommodate a plurality of cooling elements in a replaceable manner in an especially preferred embodiment of the cooling device according to the present invention. An especially efficient cooling of the gas to be cooled, especially an especially homogeneous cooling of the gas to be cooled can be made possible by providing a plurality of cooling surfaces for the heat exchange by accommodating a plurality of cooling elements. Furthermore, the use of the cooling element according to the present invention is especially advantageous in this exemplary embodiment, because the cooling element according to the present invention is especially robust and it thus makes possible a rapid removal or replacement of the cooling element and consequently also of a plurality of cooling elements.

In another preferred embodiment, it is possible to accommodate a cooling element within the device volume via a corresponding receiving compartment, wherein the first plate outer wall and the second plate outer wall of the cooling element are essentially in contact with a corresponding receiving wall of the receiving compartment if the cooling element is arranged in the receiving compartment. The cooling element can be arranged especially precisely in a predefined position within the cooling device in this embodiment. As a result, an especially efficient cooling is possible. The cooling element according to the present invention is especially advantageous in this embodiment, because its outer structure does not essentially change during temperature changes because of the arched structure of the plate inner walls. Seizing of the cooling element according to the present invention within a receiving compartment is avoided hereby.

Furthermore, a closed-circuit respirator with a cooling device according to at least one of the above embodiments is proposed to accomplish the object according to the present invention.

Due to the cooling device with the at least one cooling element according to the present invention, the closed-circuit respirator according to the present invention can be prepared for a use especially rapidly. In particular, the at least one cooling element can be used or replaced especially rapidly and simply. As a result, error-free operation of the cooling device according to the present invention, especially a secure and reliable use or replacement of cooling elements, is possible even in case of a distraction due to events occurring in the surrounding area, which may typically occur at sites at which closed-circuit respirators are typically used. In particular, seizing of the cooling element because of an overpressure within the cooling element is avoided.

The present invention shall be explained now in more detail on the basis of advantageous exemplary embodiments shown schematically in the figures.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF PREFERRED EMBODIMENTS

Figure 1:
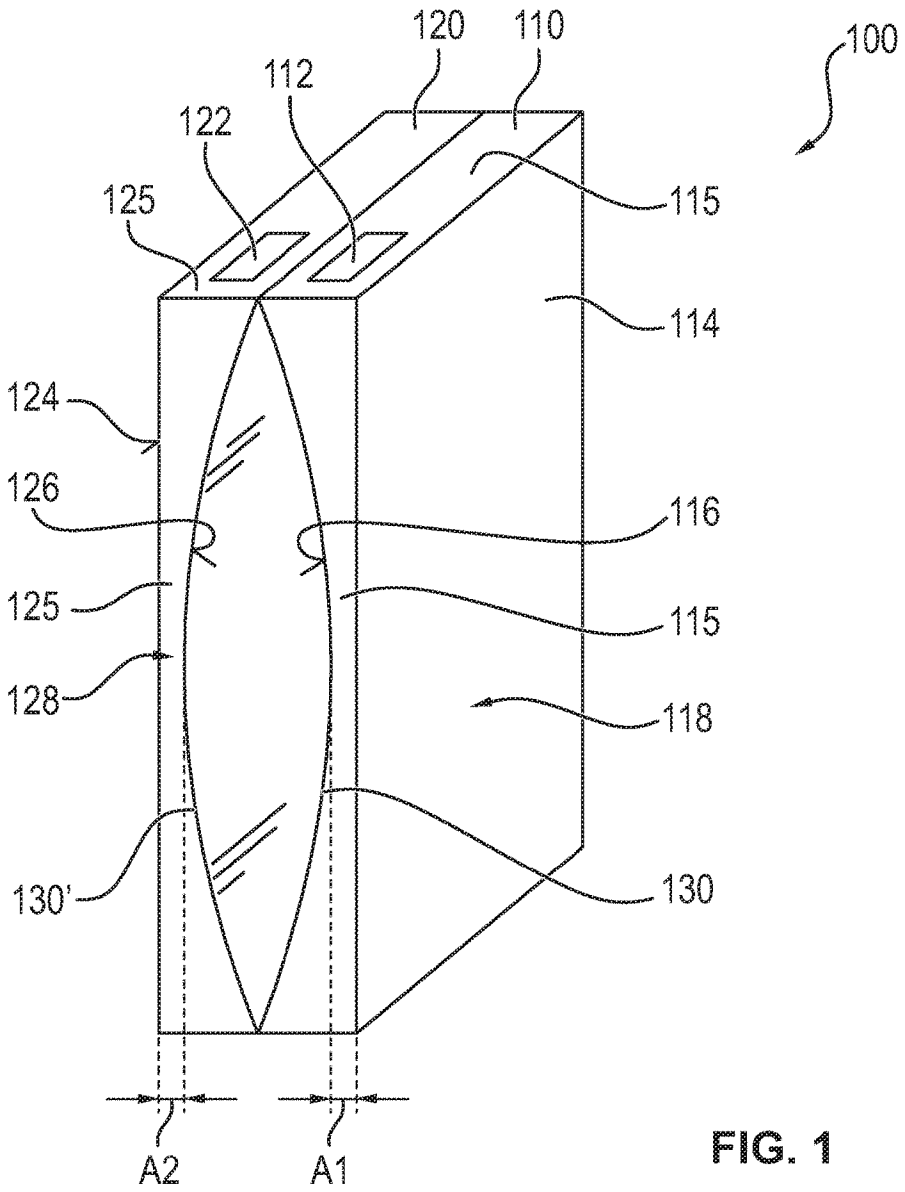
FIG. 1 is a schematic view of a first exemplary embodiment of a cooling element according to the present invention.

Referring to the drawings, FIG. 1 shows a schematic view of a first exemplary embodiment of a cooling element 100 according to the present invention.

The cooling element 100 is configured for use within a cooling device of a closed-circuit respirator and has a first plate shape cooling element housing 110 and a second plate shape cooling element housing 120.

In the exemplary embodiment shown, both cooling element housings 110, 120 are made each in one part from a plastic. In particular, both cooling element housings 110, 120 are manufactured by a twin sheet process, in which two components are deep-drawn and then bonded or welded together.

The two cooling element housings 110, 120 have here a liquid-tight closure 112, 122 each and are filled or can be filled with a coolant (not shown).

In the exemplary embodiment shown, the liquid-tight closure 112, 122 is a non-detachable, permanent closure, namely, a welded opening, through which the coolant, in this case water, was filled in prior to the welding. In one exemplary embodiment, not shown, the liquid-tight closure is a weld seam enclosing the corresponding cooling element housing. In another exemplary embodiment, not shown, the liquid-tight closure is embodied by means of a reclosable screw cap.

The first cooling element housing 110 has a first plate outer wall 114 and, essentially parallel thereto, a first plate inner wall 116 arched in the direction of the first plate outer wall 114. Together with additional first side walls 115, the first plate outer wall 114 and the first plate inner wall 116 form a first cooling element volume 118 for the coolant.

Analogously to the first cooling element housing 110, the second cooling element housing 120 has a second plate outer wall 124 and, essentially parallel thereto, a second plate inner wall 126 arched in the direction of the second plate outer wall 124. Together with additional second side walls 125, the second plate outer wall 124 and the second plate inner wall 126 form a second cooling element volume 128 for the coolant.

The respective arch 130, 130' extends in the exemplary embodiment shown over the entire width of the corresponding cooling element housing 110, 120, so that a shortest first distance A1 is formed between the first plate outer wall 114 and the first plate inner wall 116 along a straight line and a shortest second distance A2 is formed between the second plate outer wall 124 and the second plate inner wall 126, likewise along a straight line. In the exemplary embodiment shown, the shortest distance A1 is essentially equal to the shortest distance A2 and it equals less than 3.0 cm, especially less than 1.5 cm and especially less than 1.0 cm. In an alternative exemplary embodiment, the arch is spherical, so that a shortest distance is present between the plate outer wall and the plate inner wall at one point only. In another alternative or additional exemplary embodiment, arches are formed in a plurality of areas of the plate inner wall. In another exemplary embodiment, not shown, the two cooling element housings form different arches, especially different radii of curvature of the arch.

In the exemplary embodiment shown, the first plate shape cooling element housing 110 is fastened to the second plate shape cooling element housing 120 permanently via a fastening, namely, a bonding. In one exemplary embodiment, not shown, the fastening device is a mechanical fastening mechanism, especially a mechanical fastening mechanism leading to a detachable connection. In another exemplary embodiment, not shown, the first plate shape cooling element housing is welded to the second plate shape cooling element housing.

The first plate shape cooling element housing 110 and the second plate shape cooling element housing 120 are arranged permanently at one another such that the first plate inner wall 116 and the second plate inner wall 126 are located opposite each other and are arched away from one another.

Together with the additional side walls 115, 125, the two plate outer walls 114, 124 form the outer surface of the cooling element 100. The two plate outer walls 114, 124 have a stiffer configuration here than the two plate inner walls 116, 126, so that an overpressure within the respective cooling element volume 118, 128 causes the two plate inner walls 116, 126 to move at least partially towards one another. The two plate inner walls 116, 126 would correspondingly move away from one another at least partially in case of a vacuum within the respective cooling element volume 118, 128.

Figure 3:
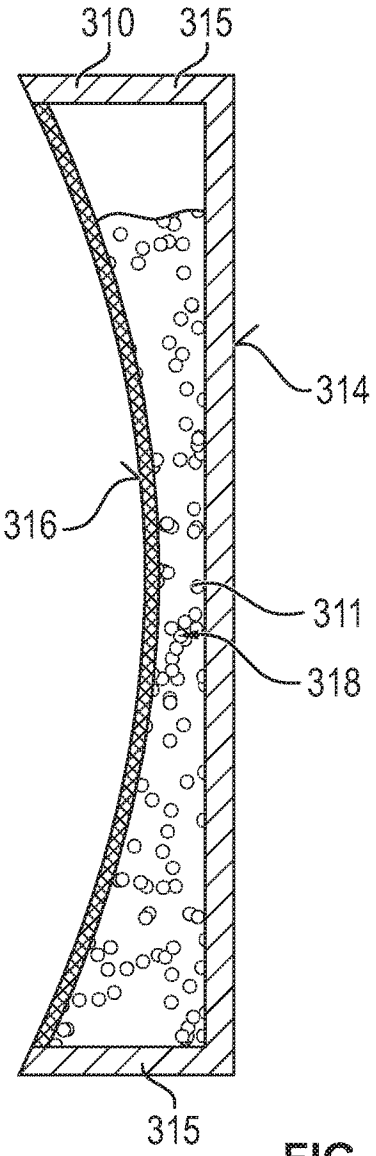
FIG. 3 is a schematic cross-sectional view of an embodiment of a cooling element housing of the cooling element according to the present invention, which is formed from two materials.
Figure 2:
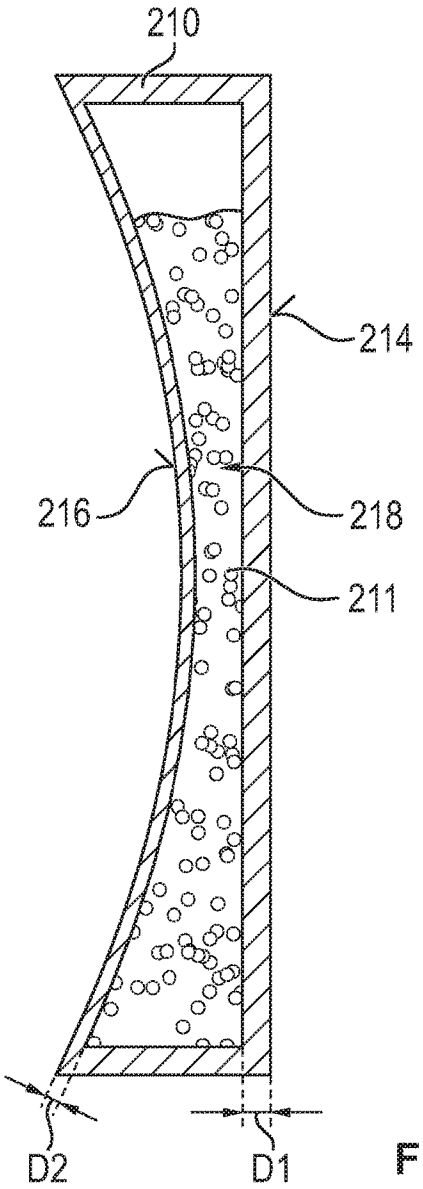
FIG. 2 is a schematic cross-sectional view of an embodiment of a cooling element housing of the cooling element according to the present invention, which has a one-part configuration.

FIG. 2 and FIG. 3 show a schematic cross section of a respective embodiment of a first cooling element housing 210, 310 of the cooling element according to the present invention, which has a one-part configuration (FIG. 2) and which is formed from two materials (FIG. 3).

The two cooling element housings of a cooling element preferably have an identical or mutually mirror-symmetrical configuration. FIGS. 2 and 3 show each a first cooling element housing 210, 310 of two different cooling elements according to the present invention in cross-sectional views. The features by which a plate outer wall that is stiffer than the corresponding plate inner wall can be embodied during the manufacture of the cooling element are illustrated hereby.

Just like the cooling element housing 110 shown in Figure, the first cooling element housing 210 shown in FIG. 2 is formed in one piece from a plastic, especially from a thermoplastic plastic, especially from a polyethylene. The plate outer wall 214 has a greater material thickness here than the plate inner wall 216. The plate outer wall 214 has a first material thickness D1 of at least 1.5 cm here, especially at least 2 mm and especially preferably at least 3 mm. The plate inner wall 216 has a second material thickness D2 of less than 1.5 mm and especially less than 1 mm in this case.

The first cooling element housing 310 shown in FIG. 3 has, contrary to the cooling element housing 210 from FIG. 2, a multipart configuration. The cooling element housing 310 has a two-part configuration here, the plate inner wall 316 being formed from a material different from that of the plate outer wall 314. In the exemplary embodiment shown, the additional side walls 315 are formed from the same material as the plate outer wall 314. The plate inner wall 316 is preferably bonded or welded to the side walls 315 or is connected to the side walls 315 by connection in substance or in another, prior-art manner.

The side walls 315 and the plate outer wall 314 are formed here from a material with a modulus of elasticity higher than that of the material of the plate inner wall 316. In the exemplary embodiment shown, the side walls 315 and the plate outer wall 314 are manufactured from a metal, whereas the plate inner wall 316 is formed from a thin-walled plastic.

The two first cooling element housings 210, 310 are filled with a coolant 211, 311 in their respective cooling element volumes 218, 318. The coolant is water in this case. The respective liquid-tight closure is not shown here and in the following exemplary embodiments. It is, however, preferably formed by means of a welding process and the weld seam formed thereby.

Figure 5:
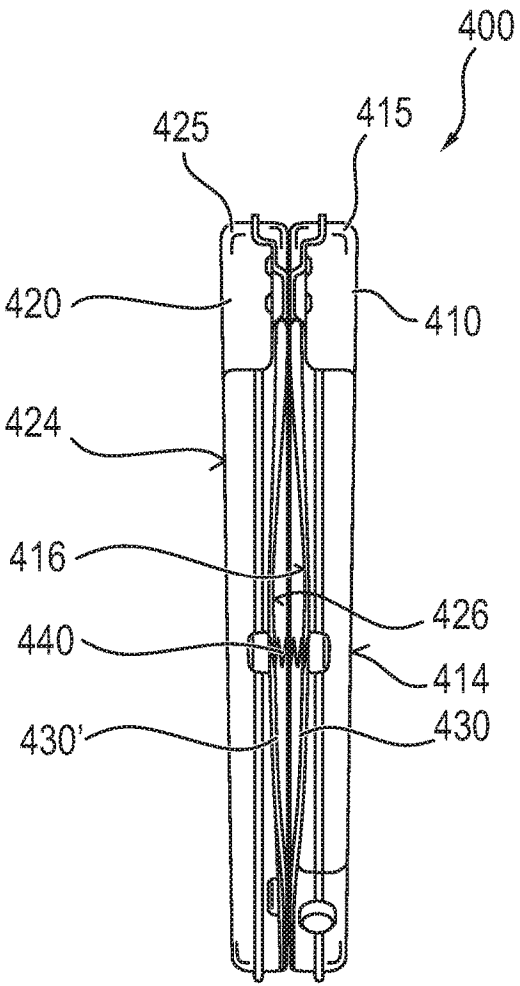
FIG. 5 is an end view of a second exemplary embodiment of the cooling element according to the present invention.
Figure 4:
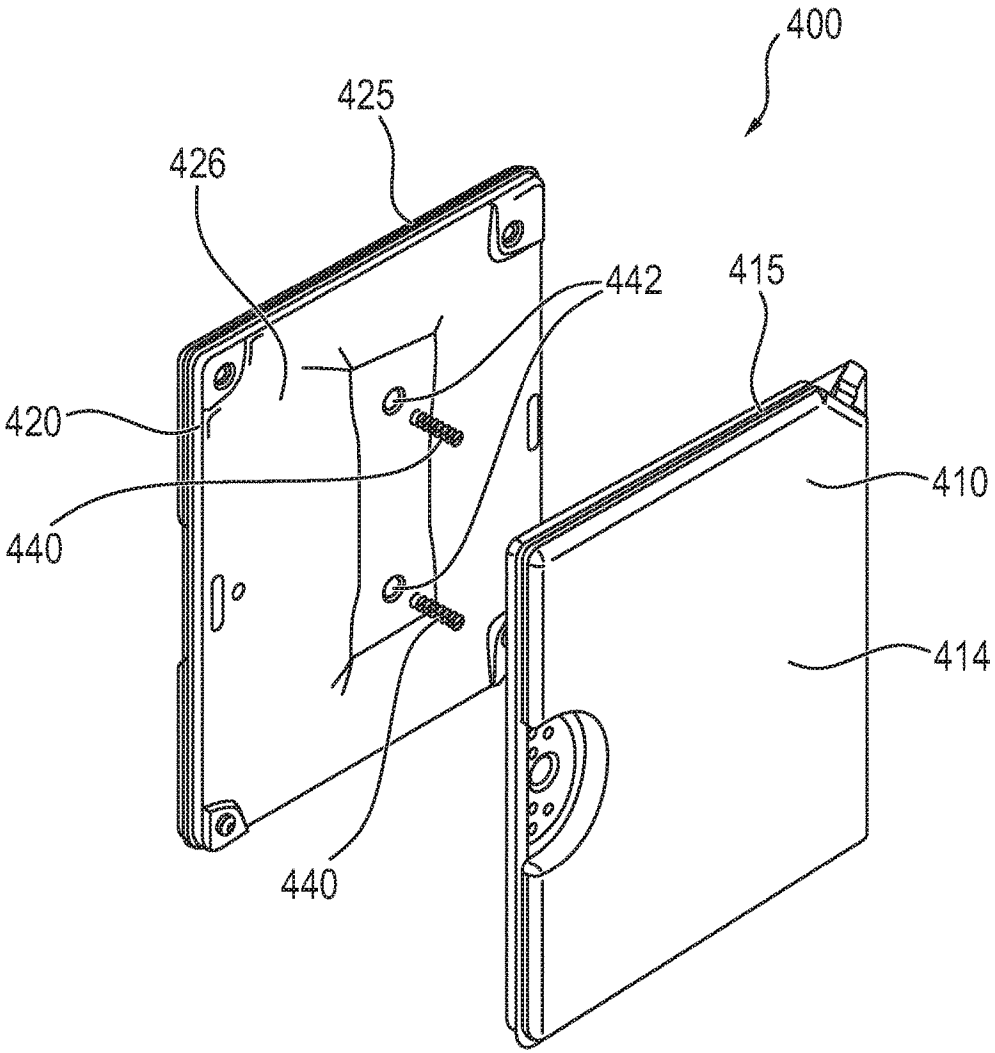
FIG. 4 is a perspective exploded view of a second exemplary embodiment of the cooling element according to the present invention.

FIG. 4 and FIG. 5 show a respective perspective view of a second exemplary embodiment of the cooling element 400 according to the present invention.

The cooling element 400 differs from the cooling element 100 from FIG. 1 in that the side walls 415, 425 and the two respective plate inner walls 416, 426 and plate outer walls 414, 424 are shaped slightly differently. The only essential difference between the cooling element 100 and the cooling element 400 is, however, that the cooling element 400 additionally has a number of elastic spacers 440.

The elastic spacers 440 are arranged at the arched-away area of the first plate inner wall 416 in a respective spacer mount 442 such that a spring force is present between the two plate inner walls 416, 426 located opposite each other as soon as the two cooling element housings 410, 420 are connected to one another, the connection being a permanent connection in this case based on a bonding at the corners of the two cooling element housings 410, 420, as is shown in FIG. 5. The spring force now counteracts an approaching movement of the arched-away areas of the two plate inner walls 416, 426.

The elastic spacers 440 are formed in this case by two elastic spacers 440, namely, two compression springs.

In one exemplary embodiment, not shown, at least one elastic spacer is arranged both at the first plate inner wall and at the second plate inner wall of the cooling element.

FIG. 4 shows a non-connected state of the first plate shape cooling element housing 410 and of the second plate shape cooling element housing 420, so that the two elastic spacers 440 are not in a compressed state.

FIG. 5 shows the connected state of the first plate shape cooling element housing 410 and of the second plate shape cooling element housing 420, which state is intended for the use of the cooling element 400 according to the present invention. It can be seen hereby how the displacement of one of the two inner walls 416, 426 causes directly a pressure on the elastic spacer 440 configured as a compression spring.

Even though the arch 430, 430' of the plate inner wall 416, 426 of the respective cooling element housing 410, 420, which arch is present, cannot be seen based on the view in FIG. 4, the view in FIG. 5 does show that the two plate inner walls 416, 426 are configured fully analogously to the structure of the cooling element 100 explained within the framework of FIG. 1 such that a free area, into which the respective plate inner wall 416, 426 can move if an overpressure is present in the respective plate shape cooling element housing 410, 420, is formed with the two spacers 440. However, contrary to the cooling element 100 from FIG. 1, the plate inner walls 416, 426 and the plate outer walls 414, 424 have the same material thickness in the cooling element 400, namely, a material thickness between 0.4 mm and 1.2 mm, especially between 0.5 mm and 1.0 mm, namely, about 0.7 mm. A stiffer plate outer wall 414, 424 is obtained in this exemplary embodiment based on the structure of the plate outer walls 414, 424.

The cooling of the cooling element 400 prior to a use is preferably carried out by a freezing aid (not shown). The expansion occurring during the cooling, for example, of water, to below the freezing point leads according to the present invention to a corresponding displacement of the two plate inner walls 416, 426 and is therefore possible, without the cooling element 400 being seized in the freezing aid based on the volume expansion.

Figure 6:
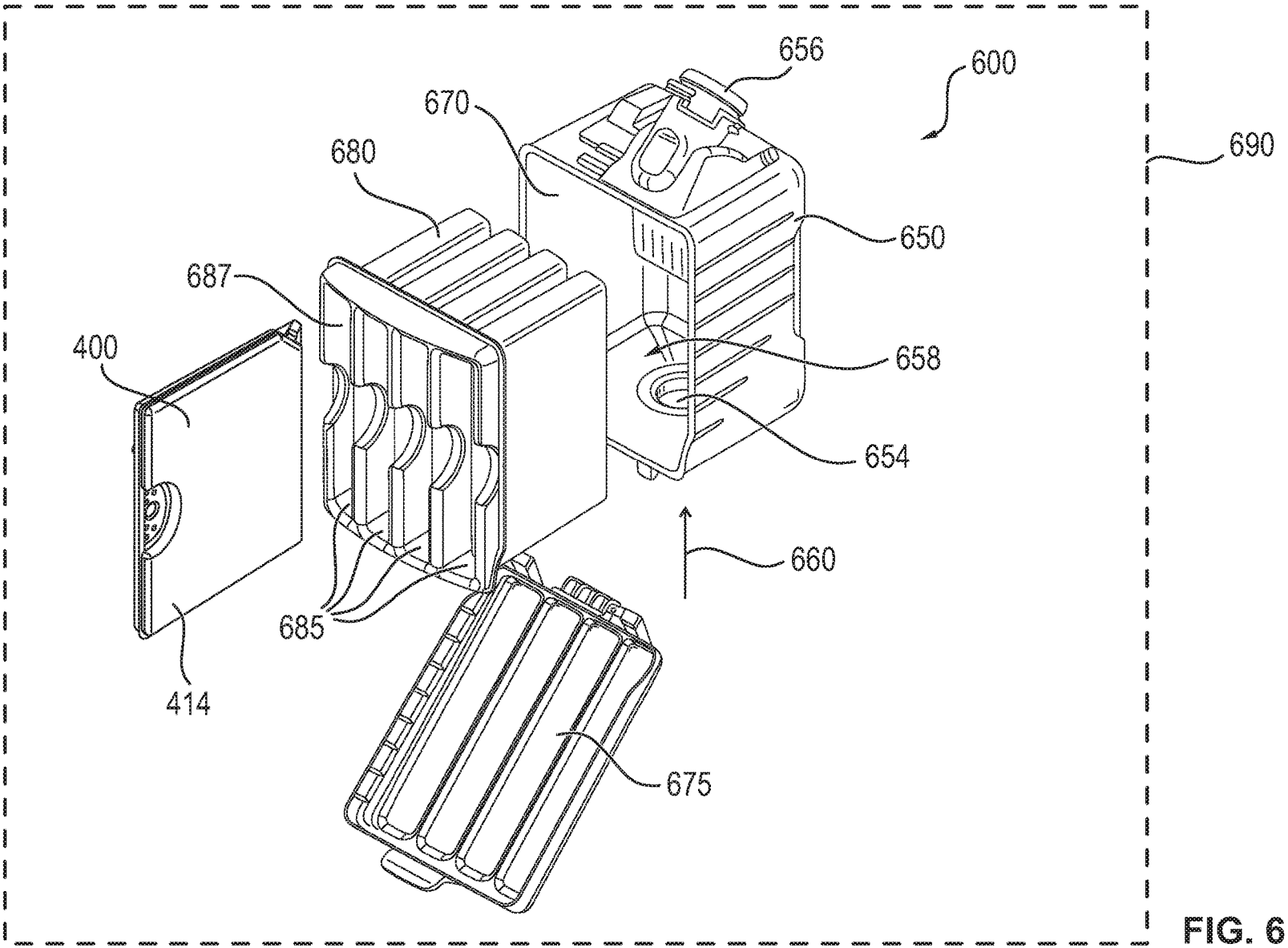
FIG. 6 is an exploded view of a first exemplary embodiment of a cooling device according to the present invention within a closed-circuit respirator according to the present invention.

FIG. 6 shows an exploded view of a first exemplary embodiment of a cooling device 600 according to the present invention.

The cooling device 600 comprises at least one cooling element 400 according to the present invention, which corresponds to the cooling element 400 shown in FIG. 4 in this case, as well as a device housing 650.

The device housing 650 has a gas inlet 654, which is configured to admit a gas 660 to be cooled (schematically indicated by its flow direction in FIG. 6) into the device housing 650. Furthermore, the device housing 650 has a gas outlet 656, which is configured to let the gas 660 to be cooled, which was admitted through the gas inlet 654 into the device housing 650, out of the device housing 650. The device housing 650 has, finally, a device volume 658 enclosed by a housing wall 670 of the device housing 650. The device volume 658 is configured here to receive a housing insert 680. The housing insert 680 is connected here to the housing wall 670 detachably via a mechanical connection, for example, a latching connection, or via a non-detachable, permanent connection, for example, by bonding or welding. There is a welded connection in the exemplary embodiment shown, and both the device housing 650 and the housing insert 680 are manufactured from a plastic, especially manufactured by means of an injection molding process.

The housing insert 680 is shaped such that it has a plurality of receiving compartments 685, in this case four receiving compartments 685, into which a respective cooling element 400 according to the present invention each can be inserted. In one exemplary embodiment, not shown, at least six cooling elements according to the present invention can be inserted into the device volume of the cooling device. Cooling elements 400 according to the present invention can be inserted into the four receiving compartments 685 if they are shaped corresponding to the receiving compartments 685. In the exemplary embodiment shown, a respective receiving compartment 685 is shaped such that the two plate outer walls 414 of the cooling element 400 are essentially in contact with a corresponding receiving wall 687 of the corresponding receiving compartment 685 if the cooling element 400 is inserted into the receiving compartment 685.

In one exemplary embodiment, not shown, at least one rail is provided at the housing wall instead of a receiving compartment in order to arrange the cooling element according to the present invention in the cooling device according to the present invention by means of the rail. No separate housing insert is provided in the cooling device according to the present invention in this exemplary embodiment, which is not shown.

The device housing 650 is configured such that a gas stream of the gas 660 to be cooled can reach the gas outlet 656 from the gas inlet 654 through the device volume 658 containing the at least one cooling element 400. In the exemplary embodiment being shown, the gas 660 to be cooled has no direct contact with the cooling element 400, but only with the housing insert 680. However, since the cooling element 400 is directly in contact with the corresponding receiving wall 687, the gas 660 to be cooled is cooled sufficiently by the contact with the housing insert 680. Based on the existing plurality of receiving compartments 685, an specially large surface is provided for the heat exchange between the housing insert 680 and the gas 660 to be cooled. This makes possible an efficient and homogeneous cooling of the gas 660 to be cooled.

The basic guiding of the breathing gas within the closed-circuit respirator 690 is known. In particular, arrangement of the cooling device 600 directly in front of an outlet of the closed-circuit respirator 690 is known, so that a user of the closed-circuit respirator 690 can use the breathing air cooled by the cooling device 600 almost directly. The gas outlet 656 is consequently arranged in the vicinity in space of the outlet of the closed-circuit respirator 690.

Furthermore, in the exemplary embodiment shown, the device housing 650 has a flap 675, which is mounted pivotably via a hinge at the housing wall 670. As a result, a user of the closed-circuit respirator 600 can have an especially rapid access to the cooling elements 400 arranged in the cooling device 600, for example, to remove or replace these cooling elements 400. The flap 675 makes, moreover, possible a secure and fixed position of the corresponding cooling element 400 in the corresponding receiving compartment 685 if it is closed. Due to the use of a separate cooling element, no sealing ring is necessary at the flap 675, unlike in the case of prior-art closed-circuit respirators, in which it is needed at times.

A separate flap (not shown), accessible from the outside, is provided in the closed-circuit respirator 690 shown, which flap allows access after opening to the flap 675 and makes thereby possible the removal or replacement of the cooling element 400 especially rapidly. This is especially advantageous in case of a time-critical use of the closed-circuit respirator 690, as is common, for example, in the area of firefighting.

While specific embodiments of the invention have been shown and described in detail to illustrate the application of the principles of the invention, it will be understood that the invention may be embodied otherwise without departing from such principles.

LIST OF REFERENCE CHARACTERS

100, 400 Cooling element
110, 210, 310, 410 First cooling element housing
112, 122 Liquid-tight closure
114, 214, 314, 414 First plate outer surface
115, 315, 415 First side walls
116, 216, 316, 416 First plate inner surface
118, 218, 318 First cooling element volume
120, 420 Second cooling element housing
124, 424 Second plate outer surface
125, 425 Second side walls
126, 426 Second plate inner surface
128 Second cooling element volume
130, 130', 430, 430' Arch
211, 311 Coolant
440 Elastic spacer
442 Spacer mount
600 Cooling device
650 Device housing
654 Gas inlet
656 Gas outlet
658 Device volume
660 Gas to be cooled
670 Housing wall
675 Flap
680 Housing insert
685 Receiving compartment
687 Receiving wall
690 Closed-circuit respirator
A1 Shortest first distance
A2 Shortest second distance
D1 First material thickness
D2 Second material thickness

What is claimed is:

1. A closed-circuit respirator cooling device cooling element comprising:

a first plate shape cooling element housing comprising a first plate outer wall, a first plate inner wall extending in the same direction as the first plate outer wall and arched in the direction of the first plate outer wall, and first side walls, the first plate outer wall, the first plate inner wall and the first side walls cooperating to form a first cooling element volume with a liquid-tight closure, the first cooling element volume being filled or being fillable with a coolant; and a second plate shape cooling element housing comprising a second plate outer wall, a second plate inner wall extending in the same direction as the second plate outer wall and arched in the direction of the second plate outer wall, and second side walls, the second plate outer wall, the second plate inner wall and the second side walls cooperating to form a second cooling element volume with a liquid-tight closure, the second cooling element volume being filled or being fillable with a coolant, wherein the first plate shape cooling element housing is fastenable or is fastened via a fastening device to the second plate shape cooling element housing such that the first plate inner wall and the second plate inner wall are located opposite each other and are arched away from one another.

2. A closed-circuit respirator cooling device cooling element in accordance with claim 1, wherein the two plate shape cooling element housings are manufactured from a plastic.

3. A closed-circuit respirator cooling device cooling element in accordance with claim 1, wherein the two plate outer walls are configured to be stiffer than the two plate inner walls within the respective cooling element housing, so that an overpressure within the respective cooling element volume moves areas of the two plate inner walls that are arched away from one another towards one another.

4. A closed-circuit respirator cooling device cooling element in accordance with claim 3, wherein at least one of the plate outer walls has a greater material thickness than the corresponding plate inner wall of the corresponding cooling element housing.

5. A closed-circuit respirator cooling device cooling element in accordance with claim 3, wherein:

the plate outer wall and the plate inner wall of at least one of the plate shape cooling element housings are formed from two different materials; and the material of the plate outer wall of the at least one of the plate shape cooling element housings a higher modulus of elasticity than does the material of the plate inner wall of the at least one of the plate shape cooling element housings.

6. A closed-circuit respirator cooling device cooling element in accordance with claim 1, wherein at least one of the plate shape cooling element housings further comprises at least one elastic spacer, which is arranged at an arched-away area of an associated one of the plate inner walls such that the at least one elastic spacer applies a spring force between the two plate inner walls located opposite each other such that the at least one elastic spacer counteracts a movement of the arched-away area of the associated plate inner wall towards an arched-away area of the other plate inner wall.

7. A closed-circuit respirator cooling device cooling element in accordance with claim 6, wherein said at least one of the plate shape cooling element housings further comprises another elastic spacer to provide a plurality of elastic spacers.

8. A closed-circuit respirator cooling device cooling element in accordance with claim 6, wherein the at least one elastic spacer comprises a compression spring.

9. A closed-circuit respirator cooling device comprising:

at least one cooling element comprising:

a first plate shape cooling element housing comprising a first plate outer wall, a first plate inner wall extending in the same direction as the first plate outer wall and arched in the direction of the first plate outer wall, and first side walls, the first plate outer wall, the first plate inner wall and the first side walls cooperating to form a first cooling element volume with a liquid-tight closure, the first cooling element volume being filled or being fillable with a coolant; and a second plate shape cooling element housing comprising a second plate outer wall, a second plate inner wall extending in the same direction as the second plate outer wall and arched in the direction of the second plate outer wall, and second side walls, the second plate outer wall, the second plate inner wall and the second side walls cooperating to form a second cooling element volume with a liquid-tight closure, the second cooling element volume being filled or being fillable with a coolant, wherein the first plate shape cooling element housing is fastenable or is fastened via a fastening device to the second plate shape cooling element housing such that the first plate inner wall and the second plate inner wall are located opposite each other and are arched away from one another; and a device housing comprising a housing wall and with a gas inlet configured to admit a gas to be cooled into the device housing, a gas outlet configured to let the gas admitted through the gas inlet out of the device housing and a device volume enclosed by the housing wall, the device housing being configured to replaceably receive the at least one cooling element and being configured such that a gas stream of the gas to be cooled reaches the gas outlet from the gas inlet through the device volume containing the at least one cooling element.

10. A closed-circuit respirator cooling device in accordance with claim 9, wherein the device volume is configured to replaceably accommodate a plurality of cooling elements.

11. A closed-circuit respirator cooling device in accordance with claim 9, further comprising a receiving compartment configured to receive the at least one cooling element, to position the at least one cooling element within the device volume, wherein the first plate outer wall and the second plate outer wall of the at least one cooling element are in contact with a corresponding receiving wall of the receiving compartment with the at least one cooling element arranged in the receiving compartment.

12. A closed-circuit respirator cooling device in accordance with claim 9, wherein the two plate outer walls are configured to be stiffer than the two plate inner walls within the respective cooling element housing, so that an overpressure within the respective cooling element volume moves areas of the two plate inner walls that are arched away from one another towards one another.

13. A closed-circuit respirator cooling device in accordance with claim 12, wherein at least one of the plate outer walls a greater material thickness than the corresponding plate inner wall of the corresponding cooling element housing.

14. A closed-circuit respirator cooling device in accordance with claim 12, wherein:

the plate outer wall and the plate inner wall of at least one of the plate shape cooling element housing are formed from two different materials; and the material of the plate outer wall of the at least one of the plate shape cooling element housings has a higher modulus of elasticity than does the material of the plate inner wall of the at least one of the plate shape cooling element housings.

15. A closed-circuit respirator cooling device in accordance with claim 9, wherein the at least one cooling element further comprises at least one elastic spacer, which is arranged at an arched-away area of an associated one of the plate inner walls such that the at least one elastic spacer applies a spring force between the two plate inner walls located opposite each other such that the at least one elastic spacer counteracts a movement of the arched away area of the associated plate inner wall towards an arched-away area of the other plate inner wall.

16. A closed-circuit respirator comprising a cooling device, the cooling device comprising:

at least one cooling element comprising:

a first plate shape cooling element housing comprising a first plate outer wall, a first plate inner wall extending in the same direction as the first plate wall and arched in the direction of the first plate outer wall, and first side walls, the first plate outer wall, the first plate inner wall and the first side walls cooperating to form a first cooling element volume with a liquid-tight closure, the first cooling element volume being filled or being fillable with a coolant; and a second plate shape cooling element housing comprising a second plate outer wall, a second plate inner wall extending in the same direction as the second plate outer wall and arched in the direction of the second plate outer wall, and second side walls, the second plate outer wall, the second plate inner wall and the second side walls cooperating to form a second cooling element volume with a liquid-tight closure, the second cooling element volume being filled or being fillable with a coolant, wherein the first plate shape cooling element housing is fastenable or is fastened via a fastening device to the second plate shape cooling element housing such that the first plate inner wall and the second plate inner wall are located opposite each other and are arched away from one another; and a device housing comprising a housing wall and with a gas inlet configured to admit a gas to be cooled into the device housing, a gas outlet configured to let the gas admitted through the gas inlet out of the device housing and a device volume enclosed by the housing wall, the device housing being configured to replaceably receive the at least one cooling element and being configured such that a gas stream of the gas to be cooled reaches the gas outlet from the gas inlet through the device volume containing the at least one cooling element.

17. A closed-circuit respirator in accordance with claim 16, wherein the device volume is configured to replaceably accommodate a plurality of cooling elements.

18. A closed-circuit respirator in accordance with claim 16, further comprising a receiving compartment configured to receive the at least one cooling element, to position the at least one cooling element within the device volume, wherein the first plate outer wall and the second plate outer wall of the at least one cooling element are in contact a corresponding receiving wall of the receiving compartment with the at least one cooling element arranged in the receiving compartment.

19. A closed-circuit respirator in accordance with claim 16, wherein the two plate outer walls are configured to be stiffer than the two plate inner walls within the respective cooling element housing, so that an overpressure within the respective cooling element volume moves areas of the two plate inner walls that are arched away from one another towards one another.

20. A closed-circuit respirator in accordance with claim 16, wherein the at least one cooling element further comprises at least one elastic spacer, which is arranged at an arched-away area of an associated one of the plate inner walls such that the at least one elastic spacer applies a spring force between the two plate inner walls located opposite each other such that the at least one elastic spacer counteracts a movement of the arched-away area of the associated plate inner wall towards an arched-away area of the other plate inner wall.

* * * * *